US007347057B1

(12) United States Patent
Garrabrant et al.

(10) Patent No.: US 7,347,057 B1
(45) Date of Patent: Mar. 25, 2008

(54) CONTROL OF DUAL-HEATED ABSORPTION HEAT-TRANSFER MACHINES

(75) Inventors: Michael Alan Garrabrant, Unicoi, TN (US); Ronald Paul Soka, Toledo, OH (US)

(73) Assignee: Cooling Technologies, Inc., Toledo, OH (US)

( * ) Notice: Subject to any disclaimer, the term of this patent is extended or adjusted under 35 U.S.C. 154(b) by 547 days.

(21) Appl. No.: 11/010,997

(22) Filed: Dec. 12, 2004

Related U.S. Application Data

(60) Provisional application No. 60/481,783, filed on Dec. 12, 2003.

(51) Int. Cl.
*F25B 15/00* (2006.01)

(52) U.S. Cl. ..... 62/148; 62/476; 62/483

(58) Field of Classification Search ..... 62/148, 62/101, 476, 324.2, 483, 484
See application file for complete search history.

(56) References Cited

U.S. PATENT DOCUMENTS

| | | | | |
|---|---|---|---|---|
| 3,774,397 | A | 11/1973 | Engdahl | 60/107 |
| 3,979,914 | A | 9/1976 | Weber | 60/644 |
| 4,044,559 | A | 8/1977 | Kelly | 60/525 |
| 4,185,465 | A | 1/1980 | Shaw | 60/678 |
| 4,237,696 | A | 12/1980 | Coblentz | 62/93 |
| 4,307,574 | A | 12/1981 | Gamell | 60/676 |
| 4,372,129 | A | 2/1983 | Bennett et al. | 62/175 |
| 4,712,380 | A | 12/1987 | Smith | 60/641.2 |
| 4,712,610 | A | 12/1987 | Kesten et al. | 165/104 |
| 4,781,033 | A | 11/1988 | Steyert et al. | 62/514 JT |
| 4,882,907 | A | 11/1989 | Brown, II | 60/649 |
| 5,033,413 | A | 7/1991 | Zenz et al. | 122/4 D |
| 5,228,293 | A | 7/1993 | Vitale | 60/641.14 |
| 5,522,356 | A | 6/1996 | Palmer | 123/236 |
| 5,526,646 | A | 6/1996 | Bronicki et al. | 60/641.2 |
| 6,029,454 | A | 2/2000 | Kefer et al. | 60/653 |
| 6,195,997 | B1 | 3/2001 | Lewis et al. | 60/648 |
| 6,250,100 | B1 * | 6/2001 | Funai et al. | 62/497 |
| 6,276,152 | B1 * | 8/2001 | Sibik | 62/201 |
| 6,658,870 | B1 * | 12/2003 | Jenkins | 62/141 |
| 6,735,963 | B2 | 5/2004 | Sarkisian et al. | 62/148 |
| 2002/0178739 | A1 * | 12/2002 | Hoshino et al. | 62/148 |
| 2003/0000213 | A1 * | 1/2003 | Christensen et al. | 60/670 |

* cited by examiner

*Primary Examiner*—Chen Wen Jiang
(74) *Attorney, Agent, or Firm*—Kremblas, Foster, Phillips & Pollick

(57) ABSTRACT

An absorption, heat-transfer system with an operationally interconnected generator, absorber, condenser, and evaporator; at least two separate heat sources for heating the generator; and a controller for controlling the heat sources. The controller, e.g., a programmed microprocessor, receives inputs from the absorption system, the heat sources, and loads and a lookup table and provides outputs to select and control the heat sources and maximize their efficiency. A heat distributor and a heat recover unit enable heat source management and additional energy utilization.

18 Claims, 2 Drawing Sheets

CONTROL OF DUAL-HEATED ABSORPTION HEAT-TRANSFER MACHINES

CROSS REFERENCE TO RELATED APPLICATION

This application claims the benefit of U.S. Provisional Application 60/481,783 filed on Dec. 12, 2003 all of which is incorporated by reference as if completely written herein.

BACKGROUND OF THE INVENTION

1. Field of the Invention

This invention relates to absorption heat transfer systems using multiple sources of heat input for generator heating and more particularly the control systems for monitoring and optimizing the use of each of the multiple sources of heat input.

2. Background

Absorption heat-transfer machines comprise a family of heat energy driven machines that can provide heating, cooling or both heating and cooling. Hundreds of thermodynamic cycles and working fluids are utilized and/or described in the literature. The fluid used in the operation of these systems is typically called a solution pair or strong solution and includes ammonia-water and lithium bromide-water pairs. Energy sources include, but are not limited to, combustion of fossil fuels (e.g., natural gas, propane, liquified natural gas (LNG), oil, methane, butane, waste oil, wood, and other biomass), solar heating, and unused and waste energy streams. Waste energy streams include, but are not limited to, flue (exhaust) gas from combustion engines, turbines, industrial and commercial processes, fuel cells, cooling loops for combustion engines, turbines, fuel cells, and industrial and commercial processes. These heat sources are available in gas or liquid forms. Absorption heat-transfer machines can be fired by single heat sources or multiple heat sources as set forth in U.S. Pat. No. 6,250,100 and U.S. Pat. Appln. Pub. No. 2003/0000213 A1. When multiple heat sources are used, one or more of the heat sources can be available only part of the time, or in partial quantity, at any given time when operation of the heat pump is desired. However, currently there are no reliable methods of controlling which of the various heat sources are used or the quantity of heat to be provided by each source.

As such, it is an object of the present invention to provide a control method for selecting a particular heat source from two or more heat sources to be used at a given time for heating an absorption heat-transfer device.

It is another object of the present invention to provide a control method for determining the amount of heat to be provided by each heat source when two or more heat sources are available.

It is another object of the present invention to determine available heat sources when two or more heat sources are used.

It is another object of the present invention to use the energy available from two or more heat sources in a cost efficient manner.

SUMMARY OF THE INVENTION

As seen in FIG. 1, the present invention features an absorption, heat-transfer system (100) with an operationally interconnected generator (2), absorber(5), condenser(3), and evaporator(4); at least two separate heat sources (two of 1, 10 or 11) for heating generator (2); and a controller (27) for controlling the heat sources (1, 10, 11). The controller (27), e.g., a programmed microprocessor, receives inputs (e.g., 502, 512, 526) from the absorption system (100), the heat sources (1, 10, 11), and loads (110 or 120) and a lookup table (72) and provides outputs (e.g., 522, 524, 532, 534) to select and control the heat sources (1, 10, 11) and maximize their efficiency. As further shown in FIG. 2, a heat distributor (300) enables further heat source management and a heat recovery unit (400) enables additional energy utilization.

The absorption, heat-transfer system 100 of the present invention comprises an operationally interconnected generator 2, absorber 5, condenser 3, and evaporator 4; at least two separate heat sources selected from energy sources 1, 10, 11, and 302 (FIG. 2) for heating generator 2; and a controller 27, operating at least one of the two separate heat sources 1, 10, 11, and 302. The absorption, heat-transfer system 100 can further comprise a heat distributor 300 comprising heat transfer loop 320 that contains a first heat transfer fluid, at least one input heat exchanger 304 or 306 for providing heat to the first heat transfer fluid in heat-transfer loop 320, a heat-transfer fluid pump 17, and a generator heat exchanger 130 for providing heat from the first heat-transfer fluid to generator 2 wherein one of two separate heat sources, e.g., heat source 302 (FIG. 2) provides heat to input heat exchanger 304 or 306. The heat distributor 300 can also have a heat recovery unit 400 that comprises a second heat transfer loop 320 that contains a second heat transfer fluid, at least one input heat exchanger 404 for providing heat to the second heat transfer fluid in loop 402 from the first heat transfer fluid in loop 320, a second heat-transfer fluid pump 410, and a load heat exchanger 406 for providing heat from the second heat-transfer fluid to a load 408. The heat recovery unit 400 can also have a second input heat exchanger 416 for providing heat to the said second heat transfer fluid in loop 402 from one of the two separate heat sources used to heat generator 2.

The absorption, heat-transfer system 100 has at least one input device such as sensors 24, 33, 52, and 430 in FIG. 1 or sensors 24, 42, 412 and 414 in FIG. 2 for providing input 502, 512, 520, and 526 in FIGS. 1 and 506, 512, 516, and 518 in FIG. 2 to controller 27. These input devices can measure: 1) an absorption cycle state point, e.g., the temperature of generator 2 as measured by sensor 24, 2) a heat source state point, e.g., the pressure of hot gas 83 as measured by sensor 430, 3) a heat source status condition, e.g., whether the heat-transfer fluid in heat-transfer loop 320 is hot or cold or at an intermediate temperature as determined by input temperature sensor 414, and 4) a load state point, e.g., the temperature of the load as measured by thermostat sensor 52. A look-up table 72 in controller 27 stores energy availability data and energy source cost rate information for input to controller 27. Energy cost information can be provided in real time from a utility company, the internet, or other provider using communications input 74.

Controller 27 also provides outputs such as outputs 522, 524, 528 530, 532, 534, and 550 in FIG. 1 and outputs 504, 508, 510, 514, and 540 in FIG. 2. These outputs are provided by controller 27 to operate control devices such as fan 128, blower 14, pumps 6, 126, valve 20, and dampers 21 and 22 shown in FIG. 1 and valves 322, 324, 326 and pumps 17 and 410 shown in FIG. 2. These devices can be heat-source control devices such as blower 14 and valve 20 and absorption-cycle control devices such as pump 6.

Controller 27 can use a variety of technologies for its implementation, e.g., mechanical switches including devices such as electromagnetic relays and contacts, manual switches, and solid state devices. Preferably controller 27 is a programmable logic controller or a programmed microprocessor. Controller 27 receives at least one input from at least one sensor of the group of sensors consisting of absorption cycle state point sensors, e.g., sensor 24, heat source state point sensors, e.g., pressure sensor 430, load sensors, e.g., temperature sensor (thermostat) 52, and heat source status sensors, e.g., temperature sensor 414. Controller 27 provides an output to at least one control of the group of controls consisting of absorption machine controls, e.g., pump 6, and heat source controls, e.g., blower 14, valve 20, and dampers 21 and 22.

At least one of the heat sources, e.g., 11, can have a by-pass conduit 32 for conducting at least a portion of the heat from the heat source 11 from the absorption, heat-transfer system. The amount of heat diverted can be controlled by controller 27 using control outputs to control the position of dampers 21 and 22.

The foregoing and other objects, features and advantages of the invention will become apparent from the following disclosure in which one or more preferred embodiments of the invention are described in detail and illustrated in the accompanying drawings. It is contemplated that variations in procedures, structural features and arrangement of parts may appear to a person skilled in the art without departing from the scope of or sacrificing any of the advantages of the invention.

It is contemplated that variations in procedures, structural features and arrangement of parts may appear to a person skilled in the art without departing from the scope of or sacrificing any of the advantages of the invention.

Figure 1:
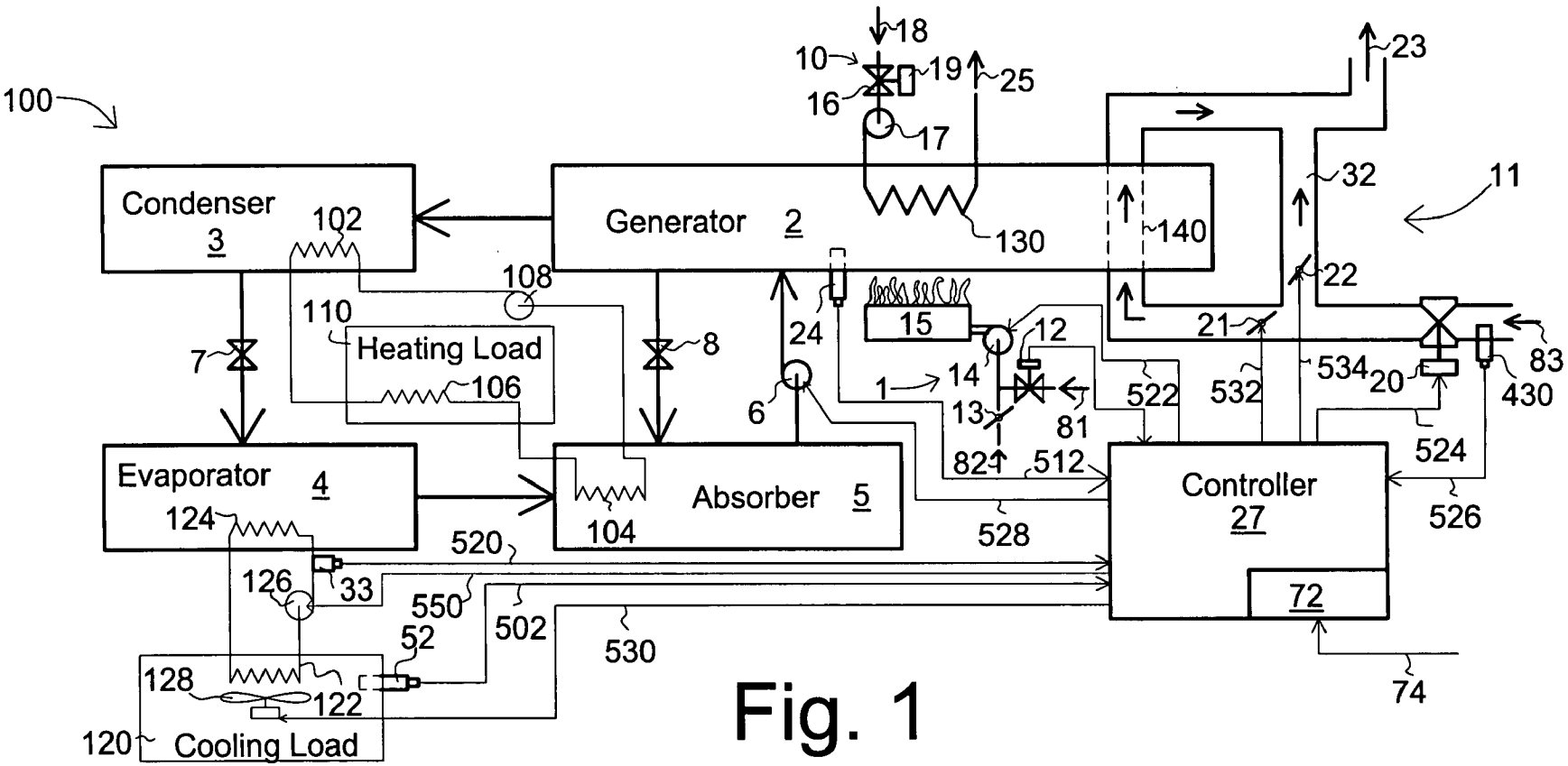
FIG. 1 is a schematic diagram of a dual-heated, absorption, heat-transfer machine with backup heating illustrating a controller and associated inputs and outputs to and from the controller.

In describing the preferred embodiment of the invention which is illustrated in the drawings, specific terminology is resorted to for the sake of clarity. However, it is not intended that the invention be limited to the specific terms so selected and it is to be understood that each specific term includes all technical equivalents that operate in a similar manner to accomplish a similar purpose.

Although a preferred embodiment of the invention has been herein described, it is understood that various changes and modifications in the illustrated and described structure can be affected without departure from the basic principles that underlie the invention. Changes and modifications of this type are therefore deemed to be circumscribed by the spirit and scope of the invention, except as the same may be necessarily modified by the appended claims or reasonable equivalents thereof.

DETAILED DESCRIPTION OF THE INVENTION AND BEST MODE FOR CARRYING OUT THE PREFERRED EMBODIMENT

Referring to FIG. 1, the present invention is an absorption heat-transfer machine 100 that comprises an operationally interconnected generator 2, absorber 5, condenser 3, and evaporator 4. In such a system, a solution pair, often called a strong solution, of, for example, ammonia and water or lithium bromide and water are formed in absorber 5 and pumped to generator 2 by means of pump 6. Heat is applied to generator 2 so as to separate the solution pair into its components, e.g., ammonia is driven off from an ammonia-water solution pair as vapor and passes to condenser 3. The remaining water, often termed a weak solution, is passed back to absorber 5 through an expansion valve 8, it being realized that the generator is at much higher pressure and temperature than absorber 5. The ammonia vapor is condensed to its liquid form in high-pressure condenser 3 with the liberation of heat after which it passes through expansion value 7 to the low-pressure evaporator 4 where it is vaporized with the application of heat. The vapor passes from evaporator 4 to low-pressure absorber 5 where it is absorbed in the water (weak solution) returning from generator 2 with the liberation of heat and the formation of a strong solution (solution pair) which is then pumped back to generator 2 by pump 6 to again repeat the process. Hundreds of variations to this basic cycle, e.g., single, half, double, triple effect, and solution pairs, e.g., ammonia-water, lithium bromide-water, are known in the art and can be used with the present invention.

As seen in FIG. 1, the heat produced by the condensation process in condenser 3 and by the absorption process occurring in absorber 5 can be used as a heat source to provide heating to a load such as load 110 which could be space heating of room space or fluid heating such as the heating of water in a hot water tank. As shown in FIG. 1, a working fluid is heated in heat exchanger 104 in absorber 5 as a result of the release of absorption heat as the vapor is absorbed into the weak solution. The working fluid is than pumped by pump 108 to heat exchanger 102 in condenser 3 where it is further heated by the condensation heat from the condensation of vapor to liquid in condenser 3. The hot working fluid is then sent to heat exchanger 106 where it heats heating load 110. The heating load 110 could be room space in which case heat exchanger 106 might be a radiator. Alternatively heat exchanger 106 could be used in a process requiring heat, such as the heating of a liquid in order to dissolve chemicals or the heating of chemical reactants in order to increase their rate of chemical reaction. As shown in FIG. 1, heating is accomplished by passing a working fluid through heat exchangers 104, or 102 or both in order to acquire the heat released by the absorption and condensation processes. However, it is possible to eliminate the working fluid and directly heat the load. For example, water could be passed through exchangers 104 and 102 and then passed to a holding tank to serves as a source of hot water. Finally it is to be noted that condenser 3 and absorber 5 could themselves be formed as heat exchangers and pass heat directly to the load.

Also as seen in FIG. 1, the heat required by the evaporation process in evaporator 4 can be used as a heat sink to cool a cooling load 120. Here heat is picked up by a working fluid from the cooling load, e.g, a room requiring cooling as an air conditioned living space or a chiller for colder refrigeration temperatures, by means of heat exchanger 122. The heated working fluid is pumped by pump 126 to heat exchanger 124 where it is used to transfer heat to the condensed fluid in order to cause its evaporation. The cold working fluid then returns to heat exchanger 122 where it again picks up heat from the cooling load 120. A blower or fan 128 can be used to facilitate the heat transfer to the working fluid. As with the heating load, the working fluid may be eliminated and a hot processing fluid, i.e., the cooling load, passed directly through exchanger 124. Or the evaporator itself may be formed as a heat exchanger and receive heat directly from the cooling load.

As illustrated in FIG. 1, the present invention features at least two separate heat sources, e.g., 1 and 10,1 and 11, or 10 and 11, for heating generator 2. Although a third (tertiary) heat source is not necessary, it may be used as a backup heat source. For example, when heat from a hot fluid source such as found in source 10 is not available, e.g., such as when the heat is provided by solar heating, and when a hot gas source as found in heat source 11, such as when the heat is provided by a combustion engine, a backup heat source such as heat source 1, a gas fired-burner may be used.

Heating device 1 illustrates the heating of generator 2 by combustion of a fuel, typically a fossil fuel such as natural gas, in burner 15. A typical arrangement for fuel combustion comprises a regulating device such as valve 12 that can be as simple as an off-on valve or a valve that has multiple or even continuous flow settings. The quantity of heat output from the fuel source can also be controlled by a combustion fan (blower) 14 that, as with fuel valve 12 can have merely an off-on setting, or multiple speed settings or a variable speed from 0-100%. When variable valves are used for both fuel and air control, blower 14 can be linked to gas valve 12 by means of a venturi that opens valve 12 to increase fuel flow 81 as the rate of blower 14 increases air flow 82. The increased air flow causes a venturi effect that open valves 12 in proportion to the amount of air flow 82.

Another option for control of the heat output from the fuel source is a combustion air damper 13 that has an off-on setting, multiple position points or a continuous position range. Typically, as are most of the valves and dampers of the current invention, the valves and dampers can be controlled by small motors or solenoids.

Heating device 1 can be used with a variety of fuels: solid fuels such as coal and biomass, liquid fossil fuels as heating oil or biomass derived fuels such as alcohol, and gaseous fuels such as natural gas or propane. For example, a fuel 81 such as coal can be metered to burner 15 by means of regulating device 12. Combustion air 82 and the rate of heat output can be controlled by the speed of combustion fan (blower) 14 or the setting of damper 13 or both the speed of combustion fan 14 and the setting of damper 13. In a similar fashion, oil or gas can be fed to burner 15 by means of regulating device 12 and combustion air controlled with either blower 14 or damper 13 or both. Also it is to be realized that the term fossil fuel as used here contemplates fuels obtained directly from nature such as coal or natural gas as well as processed fuels such as heating oil, propane, and other combustible processed fossil fuel byproducts. In additional to fossil fuels, wood and other plants matter, e.g., biomass can be used as a source of fuel. Finally it is to be noted that the above description is a general description of a fossil fuel or biomass combustion system and that other combustion systems known in the art are also contemplated by the present invention.

Heat source 10 is directed to heating generator 2 with a high-temperature (hot) fluid 18 such as may be produced, for example, by solar heating, from boilers, from engine and machinery coolants, and from liquids used to cool industrial and commercial processes. As seen in FIG. 1, hot fluid 18 passes through one or more fluid flow control devices such as value 16 or pump 17 or both, then through heat exchanger 130, which heats generator 2 by passing heat from hot fluid 18 to generator 2, and then out as cooled fluid 25 where the cool fluid may be returned to the environment, such as when the fluid is water, or recycled for cooling purposes or for disposal. Control over the quantity of heat input to generator 2 is accomplished by means of pump 17 which may have an off-on setting, multiple speed settings or a variable speed setting from 1-100%. Alternatively, control of the heat temperature fluid 18 may be accomplished by valve 16 that has an off-on setting, or multiple set points, or is variable from open to closed. Valve 16 is typically controlled by means of valve control 19 such as a solenoid or motor.

Heat source 11 (FIG. 1) is directed to heating generator 2 with a high-temperature (hot) gas stream 83, typically waste heat such as the exhaust heat from an engine, turbine, industrial or commercial process or stream. Control over the quantity of heat input to generator 2 from the high temperature gas stream 83 is accomplished by means of a valve 20 with off-on, multiple set points, or variable set-points from off to on or a damper 21, again with off-on positioning, multiple set point positioning, or variable set points from closed to completely open. As shown, valve 20 and damper 21 are located on the inlet side of generator 2; however, it is to be realized that these components may also be located on the outlet side of generator 2. As illustrated, the hot-gas stream 83 transfers heat directly to the generator through the walls of conduit 140. As recognized in the art, conduit 140 can be provided with fins, divided into multiple flow paths, or provided with surface irregularities such as fluting or dimples to increase the surface area of conduit 140 into order to increase the heat-transfer efficiency to generator 2. After transferring heat to generator 2, cooled gas stream 23 may be channeled to the atmosphere, sent to another heat recovery device for further heat extraction, or recycled through the process loop, i.e., to again cool the source from which it originated and be returned to generator 2 as high-temperature gas 83.

A by-pass channel 32 may be provided before hot gas 83 enters generator 2. Damper 22, used in conjunction with damper 21 is used to control the passage of hot gas 83 through either generator 2 or by-pass channel 32, or a combination of the two. Dampers 21 and 22 are typically sequenced in a normally open-normally closed fashion so that the passage of high-temperature gas 83 is not closed off at any time to avoid back pressure buildup at the process from which they originate when such back pressure is detrimental to the originating process. Intermediate settings of dampers 21 and 22 allow only a portion of the heat in hot gas 83 to be transferred to generator 2. Preferably dampers 21 and 22 are slow acting.

Figure 2:
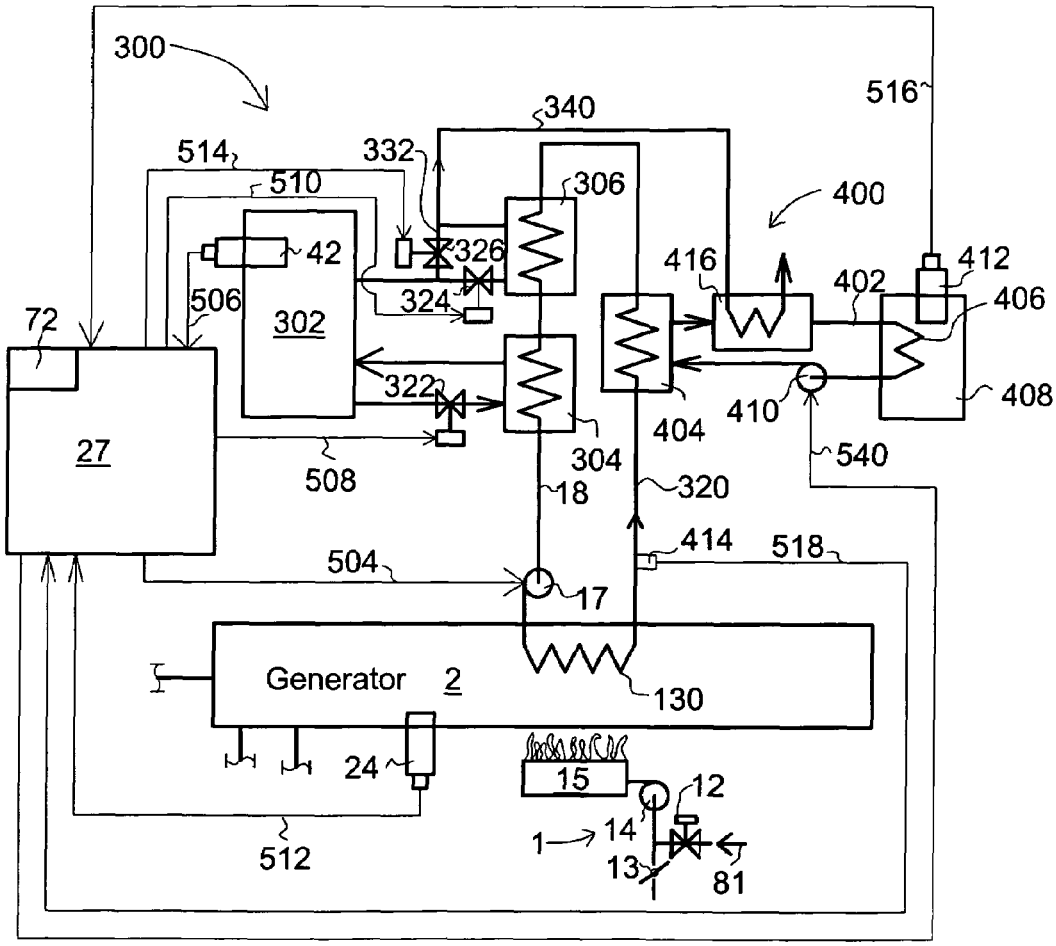
FIG. 2 is another embodiment of a dual-heated, heat-transfer machine showing only the generator of the heat-transfer machine and illustrates the use of a heat distributor and a heat recovery unit.

FIG. 2 illustrates another embodiment of at least two separate heat sources for use with generator 2. Rather than applying multiple heat sources such as FIG. 1 heat sources 1, 10, and 11 directly to generator 2, this embodiment employs a heat distributor 300 which allows for use of multiple heat source input while using a single heat exchanger 130 as the second heat source to generator 2. A heat transfer fluid circulates through heat transfer loop 320 by means of pump 17. One or more heat exchangers, e.g., heat exchangers 304 and 306, provide heat to the heat transfer fluid from a heat source 302 which may be, for example, an internal combustion engine. The heat transfer fluid then transfers heat to generator 2 by means of heat exchanger 130.

In operation, a call for heating or cooling by the absorption cycle 100 via load, state-point sensor 52 (FIG. 1 cooling call 502) is sent to controller 27 which in turn determines that generator 2 is cold as a result of input 512 from absorption cycle state point sensor 24. Input 506 to controller 27 from heat source state point sensor 42 (FIG. 2) reveals that heat source 302 is fully operational. By reference to look-up table 72 that gives heat source heating capacity and cost per energy unit, controller 27 determines that heat source 302 can fully provide the heat needed by generator 2. Controller 27 sends an output 504 that starts pump 17 and causes the heat transfer fluid to flow through heat-transfer loop 320. Controller 27 then sends on output 508 to open valve 322 which allows hot housing coolant from engine 302 to circulate through heat exchanger 304 (via engine 302 coolant pump not shown) thereby heating the circulating heat transfer fluid in heating loop 320.

If needed, a second heat exchanger 306 can also be brought online for further heating of the heat transfer fluid in heat transfer loop 320. An output signal 510 from controller 27 opens valve 324 and allows hot exhaust from internal combustion engine 302 to circulate though exchanger 306 thereby providing additional heat to the heat-transfer fluid in loop 320. As generator 2 comes to temperature as indicated by an input signal 512 from absorption cycle state point sensor 24 to controller 27, controller 27 sends an output 510 to close valve 324 and output 514 to open valve 326. This causes the hot exhaust gas to bypass heat exchanger 306 by means of bypass channel 332 and then be dumped to the atmosphere via line 340.

The heat distributor 300 allows for a multiple number of heat sources to be used to deliver heat to generator 2 by means of a single heat exchanger 130. In addition to heat exchangers 304 and 306, additional heat exchangers can be provided for heating the heat-transfer fluid in loop 320 using a variety of heat sources such as solar heating, steam from a gas turbine, a hot process fluid such as a coolant stream from an exothermic chemical reaction, etc. Each of the heat sources has a particular heating capacity and cost per energy unit that is provided in look-up table 72 in controller 27. Selection of individual heat sources for generator 2 heating is made by controller 27 on the basis of heat source availability, operational state (fully or partially operational), available heat-energy output, and absorption machine requirements as determined from the absorption cycle state-point sensor.

Another feature that can be incorporated into the heat-transfer loop 320 is a heat recovery unit 400 that comprises an interconnected second heat transfer loop 402 containing a second heat transfer fluid, a first heat exchanger 404 in heat exchange relation with and receiving heat from the heat-transfer fluid in heating loop 320, second heat exchanger 406 for heating a load such as water in hot-water tank 408 and a circulating pump 410.

In operation, a load state-point sensor, e.g., a temperature sensor 412, sends an input 516 to controller 27 that indicates that the temperature of load 408 is below a minimum set point temperature stored in lookup table 72. Controller 27 determines that heat-transfer loop is available for heat transfer such as by input 518 from temperature sensor 414. If heat is available in heat-transfer loop 320, controller 27 sends an output 540 to activate pump 410. When the required water temperature is reached as indicated to controller 27 by input 516 from sensor 412, controller 27 provides an output 540 to turn off pump 410. As a backup heat source when heat is unavailable in heat transfer loop 320, a third heat exchanger 416 can be incorporated into the second heat transfer loop 402. When no heat is available in heat transfer loop 320 as indicated by input 518 from sensor 414, hot exhaust gas from combustion engine 302 is be routed through bypass conduit 332 and would be available to heat the second heat-transfer fluid in loop 402 and the water in tank 408 by means of heat exchanger 406. Heating of load 408 is then accomplished by output 540 from controller 27 to start pump 410 that circulates heat transfer fluid through heat exchanger 406. Input 516 from temperature sensor 512 is sent to controller 27 until the set point temperature of load 408 is reached (stored in look-up table 72) at which point controller 27 sends output 540 to turn off pump 410.

As will be apparent to those skilled in the art, the above example is merely illustrative of one of many arrangements possible using the heat distributor 300 and heat recovery unit 400. Those skilled in the art would readily appreciate the many variations that are possible using a wide variety of heat sources for the heat distributor 300 to meet a wide variety of heating needs (loads) using heat recovery unit 400.

In its basic form and using two heating sources, e.g., two of 1, 10, or 11 in FIG. 1, controller 27 determines the need for cooling from input 502 from a load state point input sensor 52. Controller 27 then determines the heat source with the lowest unit energy cost from look-up table 72 and sends an output 522 to turn on the selected heat source. For heat sources with variable energy costs such as might be charged for peak demand energy, the controller could be provided with real-time energy cost input via line 74 which can be connected to the utility or other real-time data source such as the internet or other communication systems. When the heating or cooling need has been met as indicated by input from load state point sensor 52, controller 27 provides an output to turn off the selected heat source.

As further input to the controller, an absorption cycle state point sensor such as sensor 24 can provide input 512 as to the temperature of the working fluid within generator 2. If the temperature is below a certain set point, controller 27 issues outputs 522 and 524 to turn on both heat sources (here, 1 and 11) until generator 2 reaches operational temperature (a predefined set-point temperature provided in look-up table 72) determined by controller 27 from input 512 from sensor 24. Provided that either heat source alone can provide sufficient heat to operate the absorption machine 100, controller 27 would turn off the more costly heat source as determined from data in look-up table 72 and then maintain the temperature of generator 2 at a constant level as determined by input 512 from absorption cycle state point sensor 24. For small variations of temperature about the set point operating temperature, controller 27 sends an output to the energy source to increase or decrease the amount of heat provided to generator 2. For example, if heat source 1 were selected, controller 27 would send output 522 to blower 14 to increase or decrease the amount of combustion mixture provided to burner 15.

Controller 27 can use a variety of technologies for its implementation, e.g., mechanical switches including devices such as electromagnetic relays and contacts, manual switches, solid state devices, programmable logic controllers, and programmed microprocessors using the logic set forth in the above discussion. As inputs, controller 27 can receive absorption cycle state points such as, but not limited to, the peak generator solution temperature as provided by sensor 24, the generator exit temperature of the weak solution as it flows to absorber 5, the evaporator 4 temperature(s), the condenser 3 temperatures(s), absorber 5 temperature(s), cooling fluid temperature as provided by input 520 from sensor 33, ambient temperature, high side pressure (s), i.e., the pressure in the high pressure components, low side pressures, and solution flow rates. Using at least one of these inputs, controller 27 then makes logic decisions as to the heat energy input required by the absorption cycle. Controller 27 can also receive heat source state points, including but not limited to, fluid inlet temperatures, i.e., the temperature of heated fluid 18 or the temperature of hot exhaust gas 83 as provided by input 526 from sensor 430, fluid outlet temperatures, fluid inlet and outlet pressures, and fluid flow raters. Controller 27 can also receive cooling and of heating requirement inputs from cooling loads such as cooling load 120 which is provided by input 502 from sensor 52 (FIG. 1) and heating loads such as 110 and 408, the later input 516 provided by sensor 412. Heat source status inputs as to the operating condition of a heat source, i.e, on, off, or partial operation, can also be provided to controller 27. For example, input 506 provided by sensor 42 in internal combustion engine 302 (FIG. 2) would indicate whether it was operating and at what output level. As noted above, look-up table 72 can provide data as to the operating conditions and parameters of various system components such as the temperature above which the cooling load 120 requires cooling and the temperature below which cooling is no longer required, data as to energy delivery capacity of individual heat sources, data as to energy cost which may be provided in real time by connection 74 to a real time data source such as might be provided by a utility company, and other data useful in optimizing the energy efficiency of the energy transfer system 100.

Outputs from controller 27 can include but are not limited to absorption machine controls and heat source controls. For example, based on the inputs noted above, controller 27 could determine how much energy is required by the absorption machine, determine if that energy is available from the heat sources, i.e., from heat source inputs, and issue outputs to control the various valves, fans, pumps that are part of the absorption cycle. For example, if the controller determines that cooling is required and energy is available to provide that cooling, it would send output 528 to start pump 6 and pump 126. When the fluid temperature of the cooling fluid has fallen to a certain set point temperature (as determined from look-up table 72, controller 27 would issue an output 530 to start fan 128. Similarly controller 27 would determine which heat sources are available from heat source inputs, determine which input(s) are most economical to operate, and issue outputs to the heat source controls. For example, an input to controller 27 from sensor 52 calling for cooling would evoke a survey of which heat sources are available followed by a determination of which of the available heat sources could provide the required heat input at the lowest cost, which in turn would be followed by outputs to activate the requisite heat sources. For example, in response to input 502 from sensor 52 calling for cooling, controller 27 determines from heat source input and look-up data that heat source 11 is the most cost effective heat source for meeting the cooling load requirement. Controller 72 issues output 524 to open valve 20 what allows hot exhaust gas to heat generator 2. As heating progresses and generator 2 comes to operating temperature as determined by input 512 from sensor 24, controller 27 issues output 532 to close partially damper 21 and output 534 to open partially damper 22 to allow a portion of the hot exhaust gas 83 to bypass generator 2 via bypass conduit 32. It is to be noted that all possible sensors, inputs, output, and control devices have not been illustrated in the figures to avoid over complexity. However, that which has been shown is believed to enable those skilled in the art to implement those items that have not been fully illustrated.

From the above, it is apparent that when implementing controller 27 as a programmable or programmed device, various functional areas can be defined with logic to monitor, calculate, and active the various control functions necessary to operate the heat exchange system 100 for maximum efficiency and cost effective energy consumption. By identifying the energy content and cost per energy unit of each of the available heat sources, the controller's energy efficiency algorithm can develop a table of primary, secondary, and optional backup heat sources that can be blended to optimize the energy utilization and operational costs. For example, controller 27 would have a logic module that monitors the status of the system from absorption cycle state point inputs, heat source state point inputs, and heat source status inputs; and a logic module that monitors load requirements from cooling and heating load inputs. An efficiency algorithm determines the most cost effective arrangement for using available heat sources to meet load demand using look-up table for energy costs and even real time input for such costs. A control module issues outputs to the absorption system control devices and to the heat source control devices. When used, a module would be dedicated to heat distributor 300, heat recovery unit 400 and by-pass operation such as provided by dampers 21 and 22 (FIG. 1) or valves 324 and 326(FIG. 2). These modules share a common data base in the look-up table 72 that is updated in real-time with the logical inputs and outputs of each of the above modules.

It is possible that changes in configurations to other than those shown could be used but that which is shown is preferred and typical. Without departing from the spirit of this invention, various ways of arranging the components and fastening them together may be used.

It is therefore understood that although the present invention has been specifically disclosed with the preferred embodiment and examples, modifications to the design concerning sizing and shape will be apparent to those skilled in the art and such modifications and variations are considered to be equivalent to and within the scope of the disclosed invention and the appended claims.

We claim:

1. An absorption, heat-transfer system comprising:

a) an operationally interconnected generator, absorber, condenser, and evaporator;

b) at least two separate heat sources for heating said generator;

c) a controller for controlling at least one of said two separate heat sources;

d) a heat distributor comprising a heat transfer loop with a first heat transfer fluid, at least one input heat exchanger for providing heat to said first heat transfer fluid, a heat-transfer fluid pump, and a generator heat exchanger for providing heat from said first heat-transfer fluid to said generator wherein one of said at least two separate heat sources provides heat to said input heat exchanger; and e) a heat recovery unit comprising a second heat transfer loop containing a second heat transfer fluid, at least one input heat exchanger for providing heat to said second heat transfer fluid from said first heat transfer fluid, a second heat-transfer fluid pump, and a load heat exchanger for providing heat from said second heat-transfer fluid to a load.

2. The absorption, heat-transfer system of claim 1 further comprising a second input heat exchanger for providing heat to said second heat transfer fluid from one of said two separate heat sources.

3. The absorption, heat-transfer system of claim 1 further comprising at least one input device for providing input to said controller.

4. The absorption, heat-transfer system of claim 3 wherein said input device measures an absorption cycle state point.

5. The absorption, heat-transfer system of claim 3 wherein said input device measures a heat source state point.

6. The absorption, heat-transfer system of claim 3 wherein said input device measures a heat source status condition.

7. The absorption, heat-transfer system of claim 3 wherein said input device measures a load state point.

8. The absorption, heat-transfer system of claim 1 further comprising a look-up table for input to said controller.

9. The absorption, heat-transfer system of claim 8 wherein data in said loop-up table is provided in real time.

10. The absorption, heat-transfer system of claim 1 further comprising at least one output from said controller.

11. The absorption, heat-transfer system of claim 10 wherein said output operates a control device.

12. The absorption, heat-transfer system of claim 11 wherein said control device is a heat-source control device.

13. The absorption, heat-transfer system of claim 11 wherein said control device is an absorption-cycle control device.

14. The absorption, heat-transfer system of claim 1 wherein said controller is a programmable logic controller.

15. The absorption, heat-transfer system of claim 1 wherein said controller is a programmed microprocessor.

16. The absorption, heat-transfer system of claim 15 wherein said controller receives an input from at least one sensor of the group of sensors consisting of absorption cycle state point sensors, heat source state point sensors, load sensors, and heat source status sensors.

17. The absorption, heat-transfer system of claim 15 wherein said controller provides an output to at least one control of the group of controls consisting of absorption machine controls and heat source controls.

18. The absorption, heat-transfer system of claim 1 with at least one of said heat sources comprising a by-pass conduit for conducting at least a portion of the heat from said heat source from said absorption, heat-transfer system.

* * * * *